United States Patent [19]

Bartlett et al.

[11] 3,982,935

[45] Sept. 28, 1976

[54] ELECTROPHOTOGRAPHIC COPYING PROCESS

[75] Inventors: Richard F. Bartlett, Burlington; Laura K. Case, Winchester, both of Mass.

[73] Assignee: Itek Corporation, Lexington, Mass.

[22] Filed: Aug. 1, 1974

[21] Appl. No.: 494,013

Related U.S. Application Data

[62] Division of Ser. No. 855,026, Sept. 3, 1969, Pat. No. 3,879,197.

[52] U.S. Cl. ..... 96/1 R; 96/1.5; 96/1.6; 96/90 R

[51] Int. Cl.[2] ..... G03G 13/22; G03G 5/06

[58] Field of Search ..... 96/1 R, 1.5, 1.6, 90 R

[56] References Cited

UNITED STATES PATENTS

| | | | |
|---|---|---|---|
| 3,102,810 | 9/1963 | Sprague et al. | 96/90 R X |
| 3,525,612 | 8/1970 | Holstead | 96/1 R |

*Primary Examiner*—Roland E. Martin, Jr.
*Attorney, Agent, or Firm*—Homer O. Blair; Robert L. Nathans; David E. Brook

[57] ABSTRACT

This disclosure relates to an electrophotographic copying process suitable for use in a multiple copying system. The process is characterized by use of an electrophotographic medium comprising photosensitive organic compounds which are either (1) insulating prior to irradiation and substantially permanently conductive subsequent to irradiation or (2) conductive prior to irradiation and substantially permanently insulating subsequent to irradiation. The process comprises the steps of exposing the electrophotographic medium to a pattern of activating radiation to produce a latent image with a conductivity pattern that is irreversible and permanently altered and externally applying an electrical charge at any suitable time thereby forming an electrostatic pattern which can be developed by any of the known electrophotographic developing techniques. By consecutively repeating the steps of charging and developing, an indefinite number of prints can be made which are comparable in image quality and density to the original with a single step of exposure to the pattern of activating radiation. Consequently, a multiple copy system results which is substantially faster than conventional electrophotographic systems due to elimination of a requirement for repeated exposure of the electrophotographic medium to a source of activating radiation for each copy.

1 Claim, No Drawings

ELECTROPHOTOGRAPHIC COPYING PROCESS

This is a division of application Ser. No. 855,026, filed Sept. 3, 1969, now U.S. Pat. No. 3,879,197.

BACKGROUND OF THE INVENTION

1. Field of the Invention

This invention relates to improvements in electrophotography and more particularly, to an electrophotographic multiple copying system and to an electrophotographic medium useful therefor.

2. Description of the Prior Art

Electrophotographic processes are well known in the art and described in numerous publications. An early patent describing processes of this nature is U.S. Pat. No. 2,297,691 to C. F. Carlson where a base plate of relatively low electrical resistance such as metal, paper, or the like having a photoconductive insulating surface is electrostatically charged in the dark. The charged coating is then exposed to a light image. The charge leaks off rapidly to the base plate in proportion to the intensity of light to which any given area is exposed. After such exposure, the coating is contacted with electrostatic marking particles in the dark. These articles adhere to the areas where the electrostatic charges remain forming a powder image corresponding to the electrostatic image. The powder image can then be transferred to a sheet of transfer material resulting in a positive or negative print, as the case may be, having excellent detail and quality. Alternatively, where the base plate is relatively inexpensive, as of paper, it may be desirable to fix the powder image directly to the plate itself.

Materials known for the preparation of the photoconductive insulating layers required for the above-described process include selenium, sulphur, zinc oxide, various organic substances such as anthracene or anthraquinone and the like. These materials have been used alone coated onto a substrate or have been dispersed in binders with the resultant dispersions applied to supports, primarily metal foils and paper, to provide an electrophotographic medium.

Attempts have been made to provide electrophotographic media for multiple copying systems using the photoconductive insulating coating materials noted above. However, these photoconductive insulating coating materials are subject to dark decay— i.e., the conductivity pattern in the light exposed areas decreases rapidly with passage of time and the latent electrostatic image fades until it is ultimately lost. Consequently, for a multiple copying system where an excess of about three copies is desired, it is necessary to re-expose the electrophotographic medium to light in an image pattern prior to each development operation. This involves a decreased speed in the copying process and complex copying equipment.

SUMMARY OF THE INVENTION

This invention is predicated upon the discovery that certain organic photosensitive compounds can be exposed to a pattern of activating radiation to produce a latent image therein whose conductivity pattern is irreversible and will not dark decay. Based upon this irreversible conductivity pattern, an electrophotographic medium may be formulated that may be exposed to a source of activating radiation in an image pattern and thereafter may be used for making one or a multiplicity of copies using known development procedures without the requirement for re-exposure after development of each copy.

The electrophotographic copying process according to the invention comprises exposing to a pattern of activating radiation an electrophotographic medium comprising either (1) an insulating photosensitive organic compound which after irradiation becomes permanently conductive or (2) a conducting organic compound which after irradiation becomes permanently insulating, thereby producing a latent image whose conductivity pattern is irreversible and permanently altered, and developing the latent image using standard developing procedures. For example, the electrophotographic medium may be developed by charging the exposed media whereby the charge leaks off to the base plate in the exposed areas in proportion to the intensity of the activating radiation, contacting the charged plate with electrostatic marking particles whereby the particles adhere to the areas where the electrostatic charges remain forming a powder image corresponding to the electrostatic image, transfering the powder image to a sheet of transfer material resulting in a positive or negative print, as the case may be, having excellent detail and quality, and finally, fixing the powder image to the transfer material by application, for examle, of heat.

The organic photosensitive compounds contemplated by the subject invention include the reaction products of spiropyran with organic halogen derivatives capable of forming hydrohalide acids upon illumination with light, various triarylmethane dyes, aryl substituted pyrilium-3-oxides, aryl substituted indenone oxides, systems comprising cyanine dye bases and organic halogen derivatives capable of formation of hydrohalide acids upon illumination with light, systems comprising diphenylethylenes in combinations with organic halogen compounds capable of formation of hydrohalide acids upon illumination with light, systems comprising N-vinyl carbazole in combination with organic halogen compounds capable of formation of hydrohalide acids upon illumination with light, and systems comprising leuco xanthene dyes in combination with organic halogen compounds capable of formation of hydrohalide acids upon illumination with light. These organic photosensitive compounds will be described in greater detail below.

DESCRIPTION OF THE PREFERRED EMBODIMENTS

The electrophotographic media of the invention typically comprises a base material coated with an organic photosensitive compound selected from one of the following groups:

1. Systems comprising cyanine dye bases and organic halogen derivatives capable of formation of a hydrohalide acids upon illumination with light. Cyanine dye bases for photographic use are known and described in U.S. Pat. No. 3,102,810 incorporated herein by reference. They are conventionally used as "super sensitizers" in silver halide photography. Cyanine bases useful for the subject invention are characterized by the following general formula:

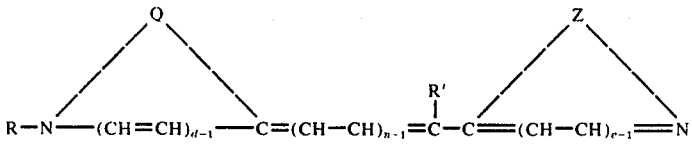

(1)

wherein $d$ and $e$ each represents a positive integer of from 1 to 2; $n$ represents a positive integer of from 1 to 4; R represents an organic radical selected from the group consisting of alkyl, aralkyl and aryl groups; R′ represents hydrogen or a cyano group; and Q and Z each represents the nonmetallic atoms necessary to complete a heterocyclic organic nucleus containing from 5 to 6 atoms in the ring.

Cyanine dye bases characterized by the above general formula may be symmetrical or unsymmetrical, of varying chain lengths; and they may have substituents on the rings or on the chain. Examples of several types are depicted below:

(1) Symmetrical Compounds

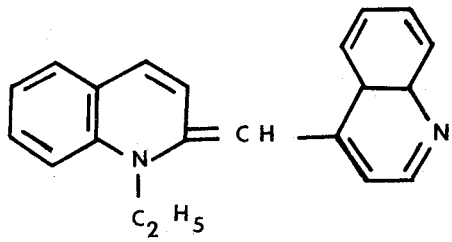

4-[1-ethyl-2-(1H)-quinolylidene)methyl]quinoline

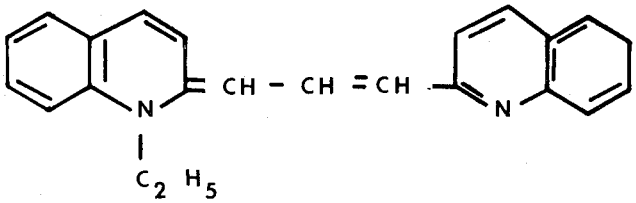

2-[3-(1-ethyl-2(1H)-quinolylidene)propenyl]quinoline

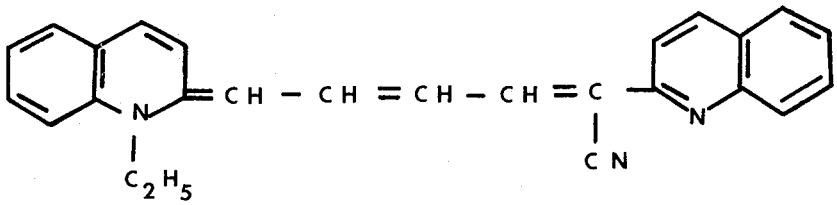

2-[1-cyano-5-(1-ethyl-2(1H)-quinolylidene)-1,3-pentadienyl]quinoline

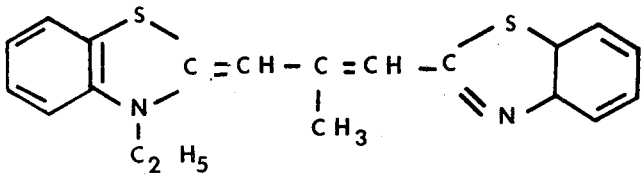

2-[2-methyl-3-(3-ethyl-2(3H)-benzothiazolylidene)-propenyl]benzothiazole

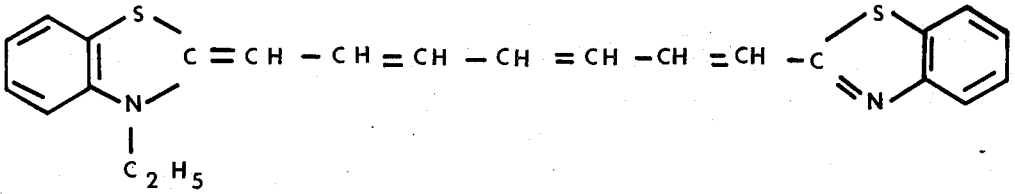

2-[7-(3-ethyl-2(3H)-benzothiazolylidone)-1,3,5-heptatrienyl]benzothiazole (2) Unsymmetrical Bases

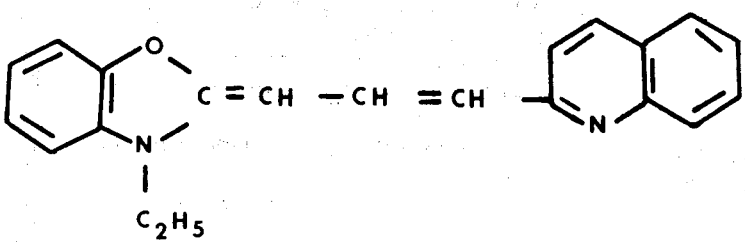

2-[3-(3-ethyl-2(3H)-benzoxazolylidene)propenyl]-quinoline

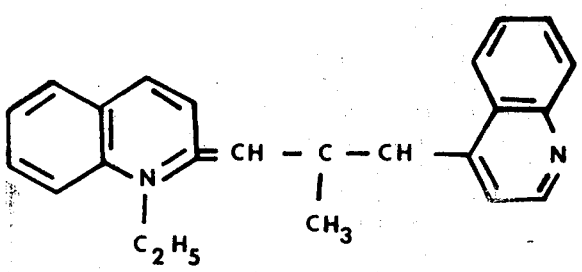

4-[2-methyl-3-(1-ethyl-2(1H)-quinolylidene)-propemyl]quinoline

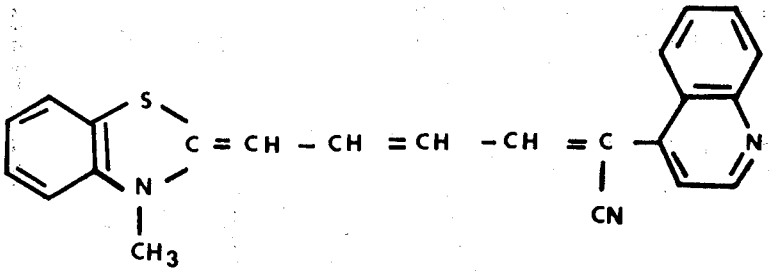

4-[1-cyano-5-(3-methyl-2(3H)-benzothiazolylidene)-1,3-pentadienyl)]quinoline

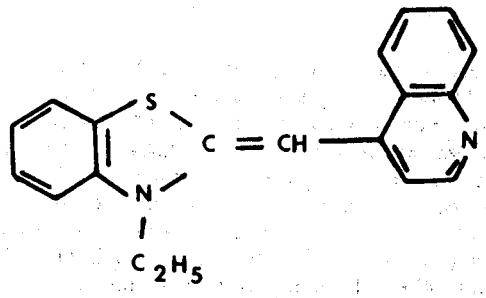

4-[(3-ethyl-2(3H)-benzothiazolylidene)methyl]quinoline

Additional examples of cyanine dye bases as well as methods for the preparation of these materials and starting materials useful therefor can be found in the above noted U.S. Patent as well as in Hamer, *The Cyanine Dyes and Related Compounds*, Interscience Publishers, 1964, Chapter 11.

2. Systems comprising the spiropyrans and organic halogen derivatives capable of formation of a hydrohalide acid upon illumination with light. The spiropyrans are disclosed in U.S. Pat. No. 3,100,778, incorporated herein by reference, and may be represented by the following structural formula:

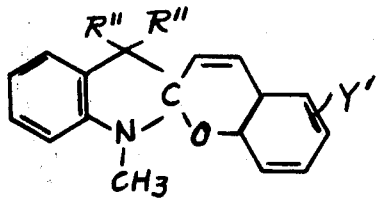

where $Y^1$ represents independently, substitutent radicals in at least two of the substituent positions, said substituent radicals being selected from the group consisting of $—NO_2$, $—OCH_3$, —Cl, —Br, —I, and —F, the substituents in said positions consisting of at least one but not more than two $—NO_2$ groups, and each R'' is independently selected from the group of hydrogen and lower alkyl. Representative examples of spiropyrans corresponding to the general formula are set forth below:

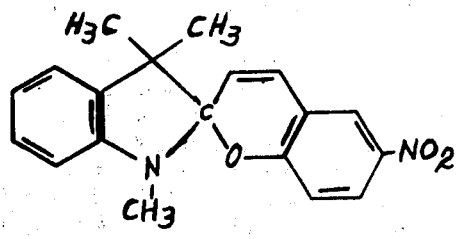

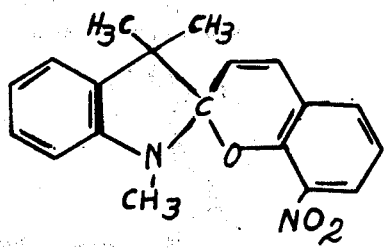

-continued

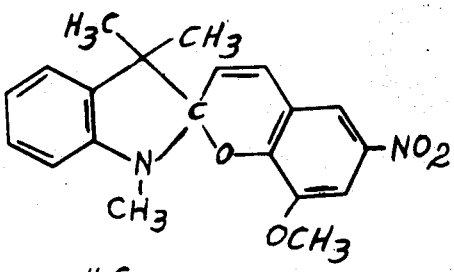

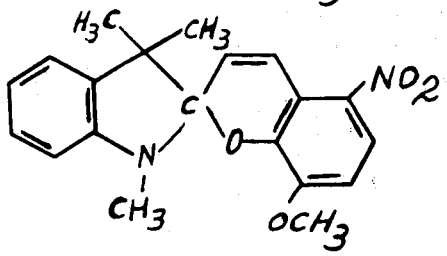

Details for formation of these compounds as well as other representative samles may be found in the above noted U.S. Pat. No. 3,100,778.

3. Systems comprising N-vinyl carbazoles in combination with organic halogen derivatives capable of formation of hydro-halide acids upon illumination with light. The N-vinyl carbazoles are disclosed in U.S. Pat. No. 3,037,861 as monomers for the formation of photosensitive polymers. They may be represented by the following general formula:

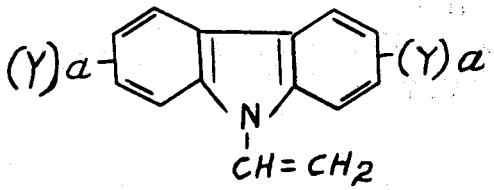

where *a* is a whole integer of from 0 to the number of replaceable hydrogen atoms on the aryl nucleus and each Y represents substituent radicals such as lower alkyl and lower alkoxy (i.e., up to 4 carbon atoms), amino nitro, halo, and the like. The preferred substituent is bromo. Representative compounds corresponding to the above general formula include:

3-bromo-9-vinylcarbazole
3,6-dibromo-9-vinylcarbazole
9-vinylcarbazole
3-chloro-6-bromo-9-vinylcarbazole
3-methyl-6-bromo-9-vinylcarbazole
3-methoxy-6-bromo-9-vinylcarbazole, and
3-nitro-6-bromo-9-vinylcarbazole 4. Systems containing phenyl substituted pyrylium-3-oxides. These compounds are disclosed in U.S. Pat. No. 3,141,770 incorporated herein by reference, as sensitizers for photoconductive layers. The aryl substituted pyrylium oxides correspond to the formula:

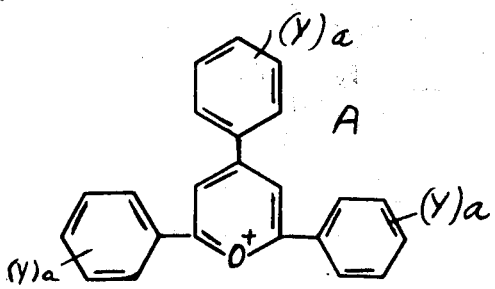

where *a* and Y are as above defined and A is an anionic function. Examples of pyrylium salts useful in the present invention include:

2,4,6-triphenylpyrylium perchlorate
4-(4-methoxyphenyl)-2,6-diphenylpyrylium perchlorate
4-(3,4-dichlorophenyl)-2,6-diphenylpyrylium perchlorate
6-(4-methoxyphenyl)-2,4-diphenylpyrylium perchlorate
2-(3,4-dichlorophenyl)-4-(4-methoxyphenyl)-6-phenyl-pyrylium perchlorate
4-(4-amyloxyphenyl)2,6-bis(4-ethylphenyl)pyrylium perchlorate
4-(4-amyloxyphenyl)-2,6-bis(4-methoxyphenyl)-pyrylium perchlorate
2,4,6-triphenylpyrylium fluoborate
2,6-bis(4-ethylphenyl)-4-(4-methoxyphenyl)-pyrylium perchlorate
2,6-bis(4-ethylphenyl)-4-(4-methoxyphenyl)-pyrylium fluoborate
6-(4-dimethylaminostyryl)-2,4-diphenylpyrylium perchlorate
2,6-bis(4-dimethylaminostyryl)-4-phenylpyrylium perchlorate
6-(1,methyl-4-p-dimethylaminophenyl-1,3-butadienyl)-2,4-diphenylpyrylium fluoborate
4-(4-dimethylaminophenyl)-2,6-diphenylpyrylium perchlorate 5. Triphenylmethane dyes corresponding to the formula:

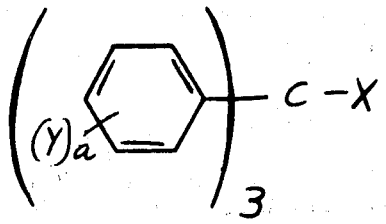

where X is an anion, for example the anion of a weak acid such as hydrogen cyanide, hydrochloric acid, hydrobromic acid, hydriodic acid, hydrothiocyanide and the like, and *a* and Y are as defined above with Y preferably in the para position. Compounds of this nature are well known in the art and include dyes such as methyl violet, ethyl violet, crystal violet, malachite green, the wool violets, aniline blue, light green S8 and many others. Representative examples of compounds corresponding to the above formula can be found in U.S. Pat. No. 3,275,442 incorporated herein by reference.

6. Systems comprising the diphenylethylenes in combination with organic halogen compounds capable of formation of hydrohalide acids upon illumination with light. The diphenylethylenes may be represented by the following formula:

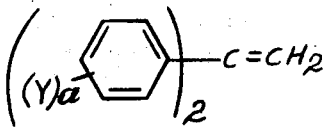

where *a* and Y are as above defined with Y preferably in the para position.

7. Phenyl substituted indenone oxides corresponding to the structural formula:

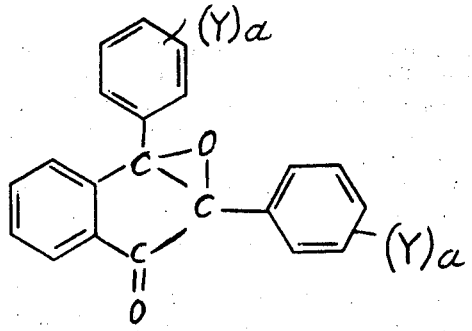

where *a* and Y are as above defined and Y is preferably in the para position.

8. Systems comprising leuco xanthenes in combination with organic halogen compounds capable of formation of hydrohalide acids upon illumination with light, said leuco xanthenes corresponding to the formula:

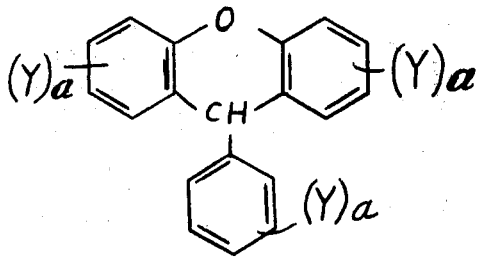

where *a* and Y are as above defined.

The organic halogen compound which decomposes to a hydrohalide acid in the presence of light suitable for the present invention preferably is a highly halogenated aliphatic or aromatic hydrocarbon, most preferably one having bromine substitution. Preferred materials of this nature include carbon tetrabromide bromoform, brominated alkyls such as penta- and hexabromoethane, $\alpha,\alpha,\alpha$-tribromoacetophenone, and halogenated sulfoxides and sulfones selected from the group:

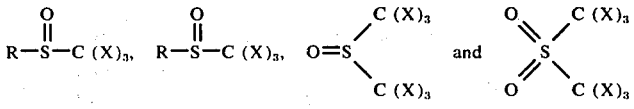

where R is aliphatic, aryl, heterocyclic or

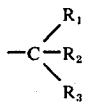

where $R_1$, $R_2$, and $R_3$ are hydrogen, chloro-, or bromo-, and X is hydrogen, chloro-, or bromo, provided that at least one X is chloro-, or bromo-, and preferably, each X is chloro- or bromo-. Representative examples of the above formulae include:

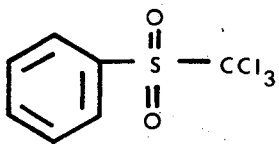

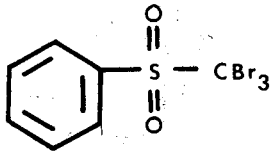

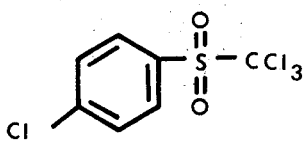

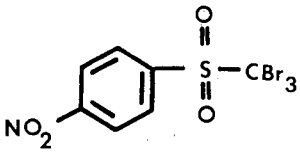

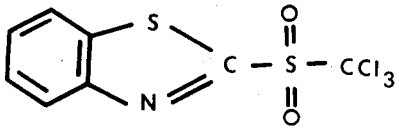

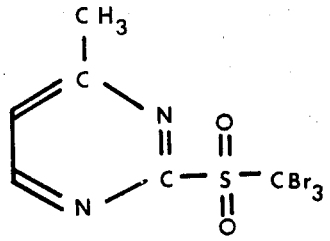

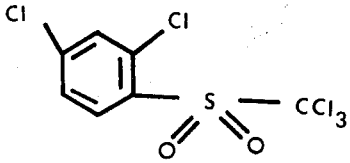

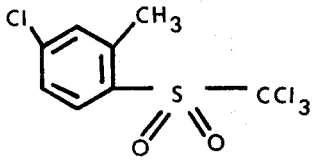

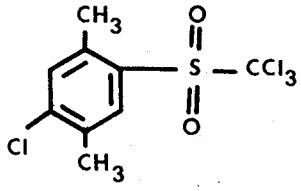

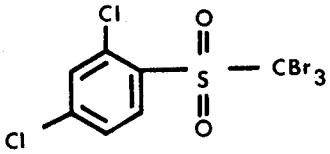

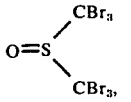

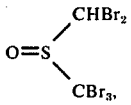

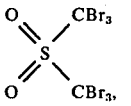

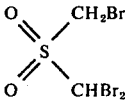

and

-continued

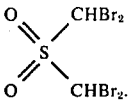

Each of the above compounds yields a halogen free radical when the bond joining a halogen atom to a poly-halogenated carbon atom is ruptured upon exposure to light. The presently preferred compounds for the invention are carbon tetrabromide and tribromoacetophenone which are readily available commercially in the requisite purity. In the manufacture of the electrophotographic medium according to the present invention, a photoconductive layer containing at least one of the photosensitive organic compounds selected from one of the groups described above is applied to a suitable support. The photoconductive layer can contain besides one or more of the organic photosensitive compounds, other compounds which confer the properties desired to the photoconductive layer and/or to the composition from which the layer is formed. Thus,in the manufacture of the photoconductive layer according to the present invention, one or more polymers can be added as binding agents to the composition in the formation of the photoconductive layer; preferably, a polymer with high specific resistivity (i.e. with a specific resistivity higher than $10^9$ ohm-cm). Polymers particularly suitable as binding agent for the photoconductive layers are natural resins, such as dammar resin, gum arabic and manilla gum; microcrystalline waxes; modified natural substances such as cellulose diacetate and cellulose triacetate, cellulose acetobutyrate, ethyl cellulose, ethyl cellulose stearate or other cellulose derivatives; polyesters or other modified colophonium resins and ester gums; polymerisates such as polyethylene, polystyrene and copolymers of styrene, polyvinyl acetate and copolymers of vinyl acetate, polyvinylacetals of formaldehyde, acetaldehyde, butyraldehyde, polyacrylic acid esters and polymethacrylic acid esters and coumarine-indene resins; and polycondensates such as glycerol-phthalate resins or other glyceryl polyesters, alkyd resins, polyethylene glycol esters, diethylene glycol polyesters, formaldehyde resins and silicon resins.

In the choice of a suitable binding material, there is no restriction to polymers. Low molecular weight compounds can be used or mixtures of low and high molecular weight compounds or semipolymerized materials which are polymerized or condensed in situ or undergo cross-linking according to methods known in the polymer arts.

If desired, suitable plasticizers such as dibutyl phthalate, dimethylphthalate, dimethylglycolphthalate, tricresylphosphate, monocresyldiphenylphosphate, etc. in quantities amounting to 10 to 30% by weight of the binding agent can be added to the compositions in the formation of the photoconductive layers.

The thickness of the layer is not critical, but is determined by the requirements for each individual formulation. Good results are obtained with electrophotographic layers which vary in thickness between 1 and 20 microns and preferably between 3 and 10 microns. Layers which are too thin possess an insufficient insulating power whereas layers which are too thick require long exposure times.

Other materials may be added to the photoconductive layer as is known in the art. For example, pigments, compounds which influence the gloss and/or the resistivity, compounds which prevent ageing or oxidation or which influence thermostability of the layers may be added. In addition, compounds which cause a change in the spectral selectivity of the photosensitive compound may be included so as to provide for activation of the layer from activating radiation within a predetermined portion of the spectrum.

In the manufacture of the electrophotographic media of the present invention, it is desirable that the photosensitive material or photoconductive layer be coated onto a base or support layer. This base or support layer should be an electrically conductive material or an insulating material provided with an electrically conductive layer. By the term "electrically conductive," it is meant that the base layer have a specific resistivity which is less than that of the photoconductive layer, i.e., in general, less than $10^9$ ohm centimeters and preferably less than $10^5$ ohms centimeters. The backing layer may be of any suitable material such as wood or rag content paper, pulp paper, plastics such as, for example, polyethylene terephthalate (Mylar) and cellulose acetate; cloth, metallic foil and glass provided that the backing layer is of sufficient strength, conductivity and durability to satisfactorily serve as a reproduction carrier. The preferred form of the backing layer is a thin sheet which is flexible and durable.

The electrophotographic medium of the invention is preferably prepared by dissolving the organic photosensitive compound and other applicable materials such as the binder in a suitable organic solvent such as benzene, acetone, glycolmonomethylether and the like, dependent upon the solubility characteristics of the components. The solution or dispersion thus obtained is uniformly spread over the surface of a suitable support, for example, by centrifuging, spraying, brushing or whirl coating and the layer is permitted to dry.

An electrophotographic medium in accordance with this invention is used for single or multiple copying in a manner analogous to a conventional xerographic processes with modification being in the processing sequence. The electrophotographic medium is imagewise exposed to a pattern of activating radiation whereby the exposed portions of the layer are made permanently conductive with unexposed portions remaining permanently insulating or the exposed portions are made permanently insulating while the unexposed portions remain conductive, dependent upon the particular organic photosensitive material used. The electrophotographic medium is then charged positively or negatively, by means of, for example, a corona discharge with a charging apparatus maintained at about 6,000 to 7,000 volts. The charge immediately leaks from the conductive portions of the electrophotographic medium and is retained on the non-conductive portions, thereby forming a latent electrostatic image which may be either a positive latent image or a negative latent image of the original dependent upon the photosensitive material used. For example, using a positive master, an organic photosensitive material that becomes permanently conductive upon exposure will form a positive electrostatic latent image. On the other hand, using an organic photosensitive material that is conductive, but becomes insulating upon exposure, a negative latent image will form upon charging due to leakage in the exposed portions. If the medium is initially insulating, the sequence can be modified to some extent by charging before exposure. In this manner, upon exposure, the charge leaks off in the exposed portions. The latent electrostatic image is then developed using procedures known in the art such as by dusting with a developer consisting of a mixture of a carrier and a toner. The carrier used may be, for example, tiny glass balls, iron powder or other inorganic substances or organic substances. The toner may consist of a resin-carbon black mixture or a pigmented resin of a grain size of about 1 to 100 microns, preferably 5 to 30 microns.

The finely distributed toner particles adhere to the parts of the electrophotographic medium in the non-conductive areas, but not to the portions of the electrophotographic medium in the conductive areas. In this way, a visible image is formed. With the same toner, but with change in the polarity of the corona discharge, there can also be obtained reversal images of the master. The visible image can be easily wiped off. It therefore has to be fixed if a single copy only is to be formed. Fixing can be accomplished, for example, by briefly heating using an infrared radiator. The temperature required is less if the heat treatment is carried out in the presence of vapors of solvents such as chloroethylene, carbon tetrachloride or ethyl alcohol. The fixing of the powder image can also be accomplished by steam treatment. Images characterized by good contrast are produced.

Where multiple copies are required, it is necessary to transfer the visible toner image to a copying medium using procedures known in the art. For multiple copying, the step of exposure in the above described process can be eliminated and the cycle for producing copies would involve charging the electrophotographic medium, cascading toner particles over the charged medium, transfering the toner image to a transfer sheet and fixing the image on the transfer sheet. This process can be repeated almost indefinitely until the electrophotographic medium physically deteriorates.

The invention will be more fully illustrated by the following examples.

EXAMPLE 1

A baryta coated paper is coated with the following:

| | |
|---|---|
| N-vinylcarbazole | 0.1 grams |
| carbon tetrabromide | 0.5 grams |
| National Starch Resyn No. 28-1300 | 0.125 grams |
| tetrahydrofuran | 10 ml |

The coated paper is air dried and exposed to an image pattern of activating radiation using a low pressure Mercury Hanovis lamp held about eight inches from the surface of the coated paper for a period of about 10 minutes. the paper is then charged using a corona charger applying about 7,000 volts negative charge to the surface of the coated paper. The paper is then developed by cascading a resin-carbon black toner mixture over the coated paper in known manner. The carbon adheres to the exposed areas and may be fixed by application of heat to give a permanent image.

EXAMPLE 2

The procedure of Example 1 may be repeated except that the electrostatic charge applied to the exposed copy medium is reversed and the powder image is transferred to a copy medium and fixed thereon. This process can be repeated for as many as 500 cycles yielding 500 copies, the entire process involving only a single exposure to the source of activating radiation.

EXAMPLE 3

A baryta coated paper is coated with a composition having the following components:

| | |
|---|---|
| N-vinylcarbazole | 0.1 grams |
| Hexabromoethane | 0.50 grams |
| National Starch Resyn No. 28-1300 | 0.1 to 5 grams |
| Tetrahydrofuran | 10 ml |

The coated paper is air dried and exposed to an image pattern of activating radiation using a low pressure mercury Hanovia lamp held about 8 inches from the surface of the coated paper for a period of about 10 minutes. A corona charge of 7,000 volts is applied and the latent image is developed in conventional manner with a carbon black powder mixture. The image is transferred by applying an electrical charge identical in sign from that of the original and the image is fixed by application of heat.

EXAMPLE 4

The procedure of Example 1 is repeated substituting 2,4,6-triphenylpyrylium-3-oxide for the N-vinylcarbazole and eliminating the carbon tetrabromide.

EXAMPLE 5

The procedure of Example 1 is repeated substituting a 2-[3-(1-ethyl-2(1H)-quinolylidene)propenyl] quinoline for the N-vinylcarbazole, all other steps remaining the same.

EXAMPLE 6

The procedure of Example 2 is repeated with the additional steps of storing the exposed copy medium in a darkened chamber for a period of four weeks. Thereafter, the copy medium is recharged and copies are prepared by forming and transferring a powder image to a receiving sheet. This process is characterized by the absence of a second exposure step.

EXAMPLE 7

The procedure of Example 1 is repeated substituting tribromoacetophenone for carbon tetrabromide.

We claim as our invention:

1. In a process for producing a visible image on an electrophotographic medium including the steps of exposing the electrophotographic medium to an image pattern of activating radiation, charging said electrophotographic medium to provide a latent electrostatic image pattern, and developing the electrostatic image pattern, the improvement wherein said electrophotographic medium comprises a conductive support having thereon a photoconductive coating formed from a photosensitive material dispersed in an organic binder having a specific resistivity of greater than $10^9$ ohm-cm and wherein said photosensitive material consists essentially of a cyanine dye base and an organic halogen derivative capable of formation of hydrohalide acid upon illumination with light, said cyanine dye base corresponding to the formula

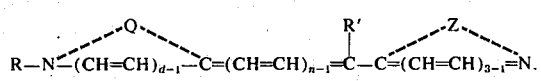

wherein $d$ and $e$ each represent a positive integer of from 1 to 2; $n$ represents a positive integer of from 1 to 4; R represents an organic radical selected from the group consisting of alkyl, aralkyl and aryl groups; R' represents hydrogen or a cyano group; and Q and Z each represent the nonmetallic atoms necessary to complete a heterocyclic organic nucleus containing from 5 to 6 atoms in the ring.

* * * * *